US006646370B2

(12) United States Patent
Takekawa et al.

(10) Patent No.: US 6,646,370 B2
(45) Date of Patent: Nov. 11, 2003

(54) CATHODE-RAY TUBE APPARATUS

(75) Inventors: Tsutomu Takekawa, Fukaya (JP); Hirofumi Ueno, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 28 days.

(21) Appl. No.: 10/025,754

(22) Filed: Dec. 26, 2001

(65) Prior Publication Data

US 2002/0079820 A1 Jun. 27, 2002

(30) Foreign Application Priority Data

Dec. 27, 2000 (JP) ..... 2000-397297

(51) Int. Cl.[7] ..... H01J 29/58
(52) U.S. Cl. ..... 313/414
(58) Field of Search ..... 313/412, 414; 315/368.11, 368.15

(56) References Cited

U.S. PATENT DOCUMENTS 5,483,128 A * 1/1996 Chen ..... 315/382

FOREIGN PATENT DOCUMENTS

| | | |
|---|---|---|
| JP | 9-330670 | 12/1997 |
| JP | 2000-188068 | 7/2000 |

* cited by examiner

*Primary Examiner*—Ross Gushi
(74) *Attorney, Agent, or Firm*—Oblon, Spivak, McClelland, Maier & Neustadt, P.C.

(57) ABSTRACT

An electron gun assembly in a cathode-ray tube apparatus includes a quadrupole lens that is created in accordance with deflection of electron beams. The quadrupole lens is created by two mutually opposing grids. The two grids have non-circular electron beam passage holes in their mutually facing surfaces. Each electron beam passage hole has a waist portion which minimizes a horizontal or vertical dimension of a region for passing the associated electron beam.

8 Claims, 8 Drawing Sheets

EMBODIMENT

CATHODE-RAY TUBE APPARATUS

CROSS-REFERENCE TO RELATED APPLICATIONS

This application is based upon and claims the benefit of priority from the prior Japanese Patent Application No. 2000-397297, filed Dec. 27, 2000, the entire contents of which are incorporated herein by reference.

BACKGROUND OF THE INVENTION

1. Field of the Invention

The present invention relates generally to a cathode-ray tube apparatus and more particularly to a color cathode-ray tube apparatus capable of improving an oval distortion of a beam spot on a peripheral portion of a phosphor screen and displaying an image with high quality.

2. Description of the Related Art

In general terms, a color cathode-ray tube (CRT) apparatus comprises an inline electron gun assembly for emitting three electron beams, which are horizontally arranged in line, and a deflection yoke for generating non-uniform deflection magnetic fields for horizontally and vertically deflecting the three electron beams. As an electron gun assembly emitting three electron beams, there is known a QPF (Quadru-Potential Focus) double-focus type electron gun assembly, which comprises, as shown in FIG. 8, three in-line cathodes K, and six grids G1 to G6 successively arranged toward a phosphor screen. Each of the grids G1 to G6 has three electron beam passage holes in association with the three in-line cathodes K.

In this electron gun assembly, a voltage of about 150V is applied to the cathodes K. The first grid G1 is grounded. The second grid G2 is connected to the fourth grid G4 within the tube and supplied with a voltage of about 600V. The third grid G3 is connected to a first segment G5-1 of the fifth grid G5 within the tube and supplied with a focus voltage of about 6 KV. A second segment G5-2 of the fifth grid G5 is supplied with a dynamic focus voltage obtained by superimposing upon a reference voltage of about 6 KV an AC component increasing in accordance with an increase in degree of deflection of electron beams. The sixth grid G6 is supplied with an anode voltage of about 26 KV.

An electron beam generating section is constituted by the cathodes K, first grid G1 and second grid G2 and generates electron beams. A prefocus lens is constituted by the second grid G2 and third grid G3 and prefocuses the electron beams emitted from the electron beam generating section. A sub-lens is constituted by the third grid G3, fourth grid G4 and first segment G5-1 and further prefocuses the electron beams. A main lens is constituted by the second segment G5-2 and sixth grid G6 and ultimately focuses the electron beams on the phosphor screen.

In a non-deflection mode in which electron beams are focused on a central portion on the phosphor screen, the electron beams generated from the electron beam generating section are focused on the phosphor screen by the prefocus lens, sub-lens and main lens. At this time, since there is no potential difference between the first segment G5-1 and second segment G5-2, a quadrupole lens is not created.

On the other hand, in a deflection mode in which electron beams are deflected onto a peripheral portion of the phosphor screen, a higher voltage is applied to the second segment G5-2 and a potential difference occurs between the first segment G5-1 and second segment G5-2. Thus, a quadrupole lens is created. The quadrupole lens created at this time has such an astigmatism that it has a horizontal focusing function and a vertical diverging function. At the same time, a potential difference between the second segment G5-2 and sixth grid G6 decreases, and the lens power of the main lens lowers. Thereby, a focus error due to an increase in distance over which the electron beams reach the phosphor screen is corrected, and a deflection aberration due to non-uniform magnetic fields is compensated.

In order to enhance the image quality of the color CRT apparatus, it is necessary to improve focus characteristics on the phosphor screen. In particular, in the case of a color CRT apparatus emitting three in-line electron beams, a beam spot on the phosphor screen may disadvantageously have an elliptically deformed core and blur portion due to deflection aberration, as shown in FIG. 9A.

In a general double-focus electron gun assembly, a low-voltage side electrode constituting the main lens is composed of a plurality of grids such as the first segment G5-1 and second segment G5-2. A quadrupole lens is created between these segments in accordance with deflection of the electron beam. Thereby, deflection aberration is compensated, and the problem of blur is improved, as shown in FIG. 9B.

However, as shown in FIG. 9B, oval deformation of the beam spot still remains at an end portion in a horizontal axis H and an end portion in a diagonal axis D on the phosphor screen. The reason is as follows. If the sub-lens, quadrupole lens, main lens and deflection aberration components included in deflection magnetic fields are assumed to be a single lens, the horizontal lens magnification increases and the vertical lens magnification decreases. This results in such oval deformation. Consequently, the vertical dimension of the beam spot becomes too small, and a moire may occur due to interference with the shadow mask. A character, etc., if formed with such a beam spot, could not easily be viewed.

To solve this problem, an electron gun assembly with a double-quadrupole lens structure is proposed. As is shown in FIG. 10, the double-quadrupole lens structure has the same basic structure as shown in FIG. 8. The third grid G3 comprises a first segment G3-1 and a second segment G3-2. The second segment G3-2 is connected to the second segment G5-2 and supplied with a dynamic focus voltage at the time of deflection.

In the deflection mode, a first quadrupole lens dynamically varying in synchronism with deflection magnetic fields is created between the first segment G3-1 and second segment G3-2. The first quadrupole lens has a horizontal diverging function and a vertical focusing function. In short, the first quadrupole lens has an astigmatism with polarities opposite to those of a second quadrupole lens created between the first segment G5-1 and G5-2.

Thereby, if the first quadrupole lens, sub-lens, second quadrupole lens, main lens and deflection aberration components included in deflection magnetic fields are assumed to be a single lens, a difference between the horizontal lens magnification and the vertical lens magnification can be decreased and the oval deformation of the beam spot improved.

Compared to the conventional double-focus electron gun assembly, this electron gun assembly with the double-quadrupole lens structure requires quadrupole lenses with higher power. In particular, the diameter of each electron beam passing through the first quadrupole lens is small. Thus, in order to obtain sufficient effect of improving oval deformation, the first quadrupole lens must have a very high lens power.

The quadrupole lens is formed by arranging a pair of grids, as shown in FIGS. 12A and 12B, such that their electron beam passage holes are opposed to each other. The electron beam passage holes in one of the grids are horizontally elongated ones, and the electron beam passage holes in the other grid are vertically elongated ones. However, a necessary lens power may not be obtained in order to sufficiently improve the oval deformation of the beam spot.

This phenomenon will now be described referring to FIGS. 13A and 13B. In FIGS. 13A and 13B, an electron beam enters from the left side in the Figures, and exits to the right side. Assume that a voltage V1 is applied to an incidence-side grid Gin, a voltage V2 is applied to an emission-side grid Gout, and V1<V2.

As regards the vertical direction, as shown in FIG. 13A, the electron beam entering the quadrupole lens suffers a strong focusing action since the vertical dimension of the incidence-side grid Gin is small. The electron beam exiting the quadrupole lens suffers a weak diverging action since the vertical dimension of the emission-side grid Gout is large. As a result, the quadrupole lens provides a relative focusing action upon the electron beam in the vertical direction.

On the other hand, as regards the horizontal direction, as shown in FIG. 13B, the electron beam entering the quadrupole lens suffers a weak focusing action since the horizontal dimension of the incidence-side grid Gin is large. The electron beam exiting the quadrupole lens suffers a strong diverging action since the horizontal dimension of the emission-side grid Gout is small. As a result, the quadrupole lens provides a relative diverging action upon the electron beam in the horizontal direction.

In the quadrupole lens having this structure, the incidence-side lens action and emission-side lens action contradict each other, and part of the lens actions is canceled. Thus, strong lens power cannot be obtained.

In a method of solving this problem, a pair of grids as shown in FIGS. 11A and 11B are arranged such that their electron beam passage holes are opposed to each other. One of the grids has screen-like projection portions at its horizontal end portions of the electron beam passage holes, and the other grid has screen-like projection portions at its vertical end portions of the electron beam passage holes.

According to this method, the lens space can be extended in the direction of travel of electron beams, and the time, over which the electron beams suffer the lens action of the quadrupole lens, can be increased. Thus, a strong lens power can be obtained.

However, in consideration of productivity, the formation of the screen-like projection portions requires cutting and bending machining by a pressing process. The dimensional precision obtained by this machining is lower than that obtained by a punching process. It is difficult to enhance the dimensional precision for forming the screen-like projection portions. This leads to variance or degradation in focusing performance, such as variance in the quadrupole lens power or undesirable deflection of electron beams. Moreover, since the grids have projections in the direction of travel of electron beams, the dimension of the grids in this direction cannot be decreased and the degree of freedom is limited in designing the electron gun assembly. Besides, the number of parts increases and consequently the manufacturing cost rises.

BRIEF SUMMARY OF THE INVENTION

The present invention aims at solving the above problems, and the object of the invention is to provide a cathode-ray tube apparatus capable of having stable and good focusing characteristics over the entire phosphor screen.

According to an aspect of the invention, there is provided a cathode-ray tube apparatus comprising:

an electron gun assembly including an electron beam generating section which generates electron beams, and a main lens which focuses the electron beams generated by the electron beam generating section on a phosphor screen; and a deflection yoke which generates deflection magnetic fields that horizontally and vertically deflect the electron beams emitted from the electron gun assembly, wherein the electron gun assembly includes at least one multi-polar lens that is created in accordance with deflection of the electron beams, the at least one multi-polar lens is created by two mutually opposing grids, the two mutually opposing grids have non-circular electron beam passage holes in their mutually facing surfaces, and each of the electron beam passage holes has a waist portion which minimizes a horizontal or vertical dimension of a region for passing the associated electron beam.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A cathode-ray tube (CRT) apparatus according to an embodiment of the present invention will now be described with reference to the accompanying drawings.

Figure 4:
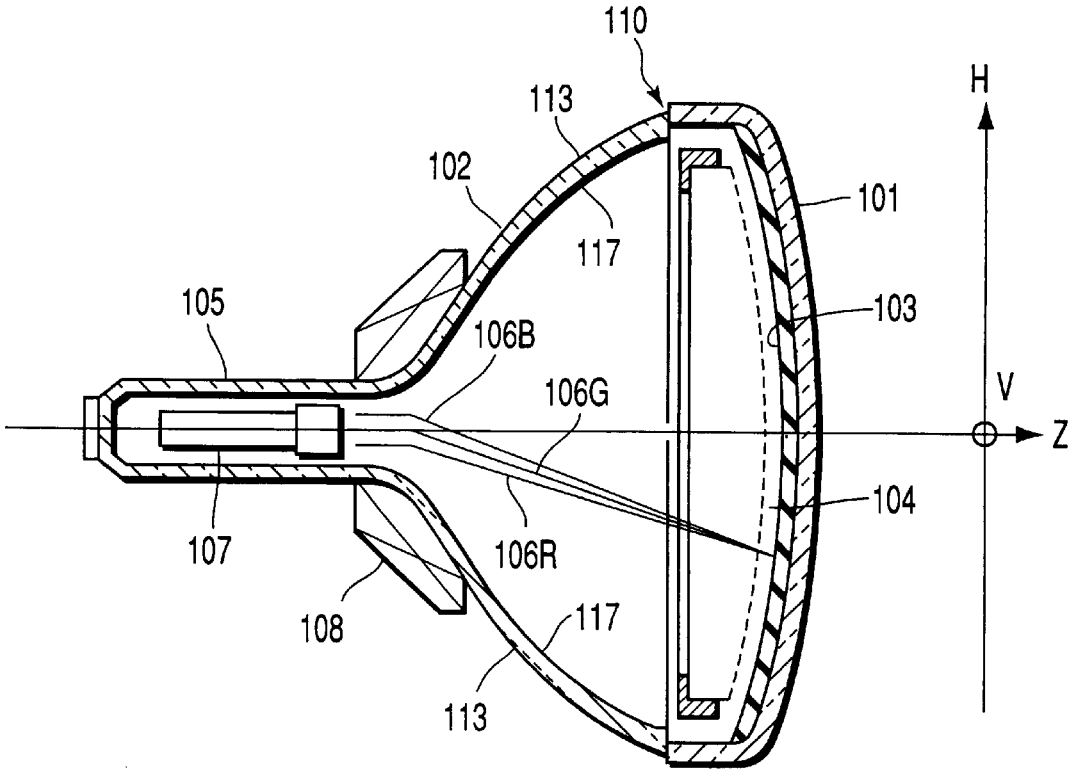
FIG. 4 is a horizontal cross-sectional view schematically showing the structure of a CRT apparatus according to the embodiment of the invention.

The CRT apparatus, i.e. a color CRT apparatus, according to the embodiment is a so-called in-line color CRT apparatus which includes an in-line electron gun assembly 107 emitting three electron beam arranged in line in a horizontal direction H, as shown in FIG. 4. The in-line color CRT apparatus has an envelope 110 comprising a panel 101, a neck 105 and a funnel 102 coupling the panel 101 and neck 105.

The panel 101 has a rectangular shape. The panel 101 has, on its inner surface, a phosphor screen 103 (target) comprising three-color striped or dot-shaped phosphor layers, which emit red (R), green (G) and blue (B) light, and a metal back layer. A shadow mask 104 is disposed to face the phosphor screen 103 at a predetermined distance therebetween. The shadow mask 104 has many apertures therein for passing electron beams.

The neck 105 has a substantially cylindrical shape with a center axis coinciding essentially with a tube axis Z. The inside part of the neck 105 has a substantially circular cross-sectional shape. The in-line electron gun assembly 107 is included in the neck 105. The electron gun assembly 107 emits three electron beams 106B, 106G and 106R arranged in line in the horizontal direction H toward the phosphor screen 103 along the tube axis Z.

Of the three electron beams, the electron beam 106G, or a center beam, travels along a trajectory closest to the center axis of the neck 105. The electron beams 106B and 106R, which are a pair of side beams, travel along trajectories on both sides of the center beam 106G.

The electron gun assembly 107 converges the three electron beams 106 (R, G, B) and at the same time focuses the three electron beams on the phosphor screen 103.

A deflection yoke 108 is mounted on that portion of the envelope 110, which extends between the neck 105 and a large-diameter portion of the funnel 102. An external conductor film 113 is formed on the outside of the funnel 102. An internal conductor film 117 is coated on the inner surface of the envelope 110 extending from the funnel 102 to a part of the neck 105. The internal conductor film 117 is electrically connected to an anode terminal for supplying an anode voltage.

The deflection yoke 108 generates non-uniform magnetic fields for deflecting the three electron beams 106 (R, G, B) emitted from the electron gun assembly 107 in the horizontal direction H and vertical direction V. The non-uniform magnetic fields comprise a pin-cushion-shaped horizontal deflection magnetic field produced by a horizontal deflection coil and a barrel-shaped vertical deflection magnetic field produced by a vertical deflection coil.

In the color CRT apparatus with this structure, the three electron beams 106 (R, G, B) emitted from the electron gun assembly 107 are deflected by the non-uniform magnetic fields generated by the deflection yoke 108, while being self-converted, and caused to scan the phosphor screen 103 via the shadow mask 4 in the horizontal direction H and vertical direction V. Thereby, a color image is displayed.

Figure 1:
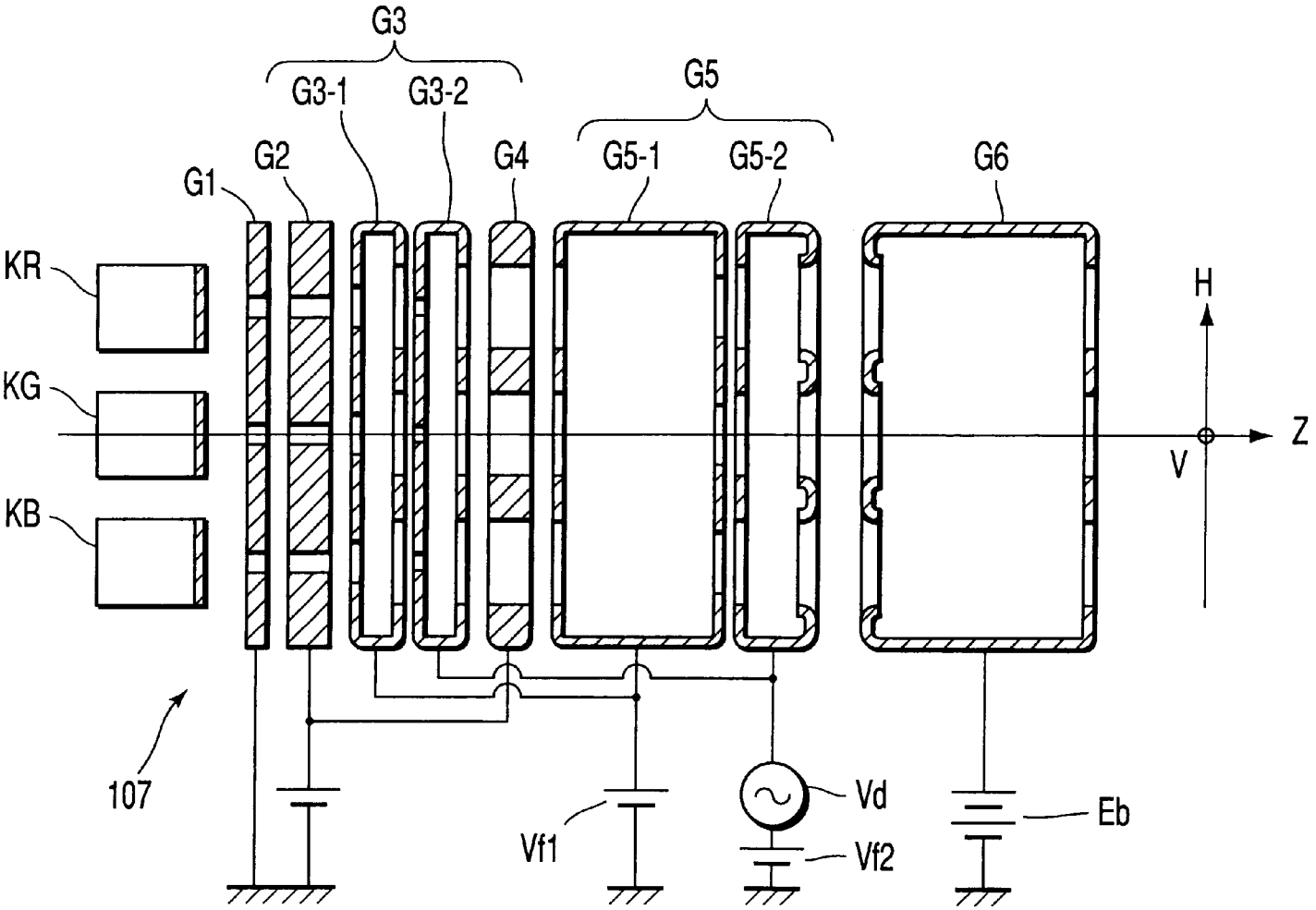
FIG. 1 is a horizontal cross-sectional view schematically showing the structure of an in-line electron gun assembly applied to a CRT apparatus according to an embodiment of the invention.

As is shown in FIG. 1, the electron gun assembly 107 applied to the color CRT apparatus comprises three cathodes K (B, G, R) arranged in line in the horizontal direction H; three heaters for individually heating the cathodes K; and first grid G1 through sixth grid G6 successively arranged in the direction of tube axis Z from the cathodes K toward the phosphor screen 103. The cathodes K (R, G, B) and the grids are integrally supported by a pair of insulating support members.

The third grid G3 is composed of at least two segments. As is shown in FIG. 1, the third grid G3 comprises a first segment G3-1 situated close to the second grid G2 and a second segment G3-2 situated close to the fourth grid G4. In addition, the fifth grid G5 comprises at least two segments. As is shown in FIG. 1, the fifth grid G5 comprises a first segment G5-1 situated close to the fourth grid G4 and a second segment G5-2 situated close to the sixth grid G6.

The first grid G1, second grid G2 and fourth grid G4 are composed of plate-shaped electrodes. Each of these plate-shaped electrodes has three substantially circular electron beam passage holes in association with the three cathodes K (R, G, B) arranged in line in the horizontal direction H.

The first segment G3-1 and second segment G3-2 of the third grid G3 are composed of cylindrical electrodes. The cylindrical electrodes have, in their end faces on the cathode K side and phosphor screen side, three substantially circular electron beam passage holes in association with the three cathodes K (R, G, B).

Figure 2A:
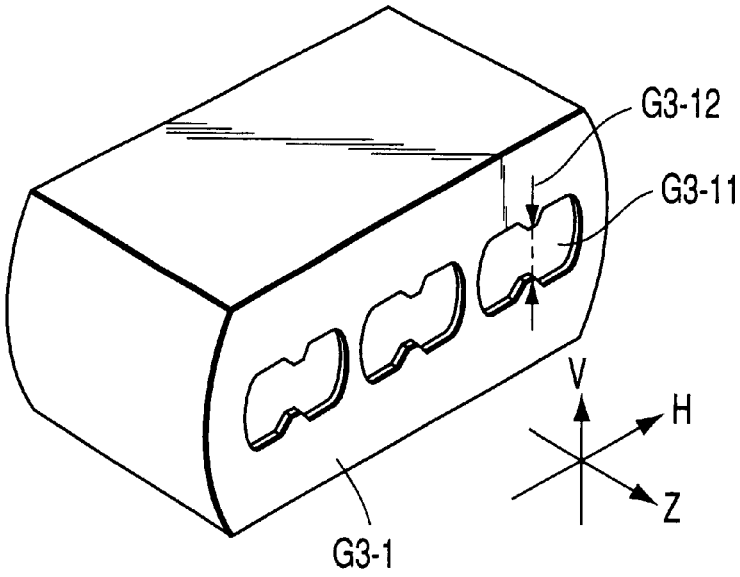
FIG. 2A is a perspective view schematically showing the structure of a first segment of a third grid in the electron gun assembly shown in FIG. 1.

As is shown in FIG. 2A, that face of the first segment G3-1, which is opposed to the second segment G3-2, has non-circular electron beam passage holes G3-11 having major axes in the horizontal direction H. Each electron beam passage hole G3-11 has a waist portion G3-12 at which the vertical dimension of the region for substantially the electron beam takes a minimum value. Specifically, the waist portion G3-12 is formed to project toward the substantial center of the cross section of the electron beam passing through the electron beam passage hole G3-11.

Figure 2B:
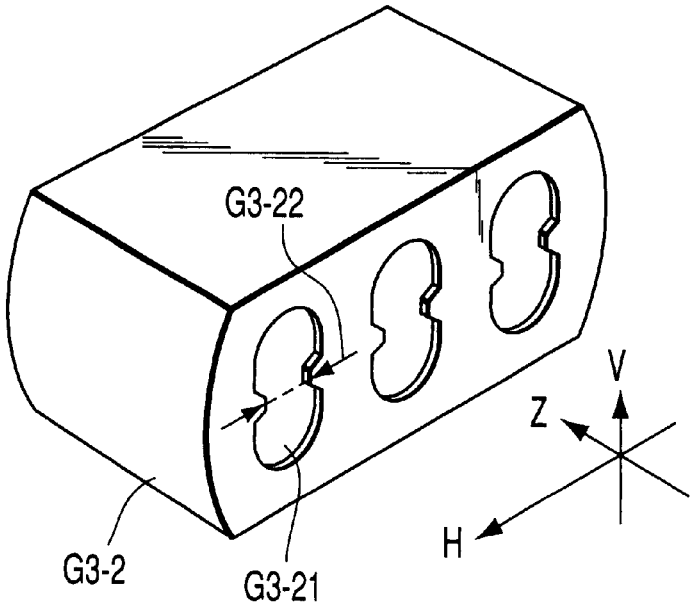
FIG. 2B is a perspective view schematically showing the structure of a second segment of the third grid in the electron gun assembly shown in FIG. 1.

As is shown in FIG. 2B, that face of the second segment G3-2 of third grid G3, which is opposed to the first segment G3-1, has non-circular electron beam passage holes G3-21 having major axes in the vertical direction V. Each electron beam passage hole G3-21 has a waist portion G3-22 at which the horizontal dimension of the region for substantially passing the electron beam takes a minimum value. Specifically, the waist portion G3-22 is formed to project toward the substantial center of the cross section of the electron beam passing through the electron beam passage hole G3-21.

The first segment G5-1 and second segment G5-2 of the fifth grid G5 are composed of cylindrical electrodes. The cylindrical electrodes have, in their end faces on the cathode K side and phosphor screen side, three substantially circular electron beam passage holes in association with the three cathodes K (R, G, B). That face of the first segment G5-1, which is opposed to the second segment G5-2, has non-circular electron beam passage holes having major axes in the vertical direction V. That face of the second segment G5-2, which is opposed to the first segment G5-1, has non-circular electron beam passage holes having major axes in the horizontal direction H.

The sixth grid G6 is composed of a cylindrical electrode. The cylindrical electrode has, in both end faces thereof on the cathode K side and phosphor screen side, three substantially circular electron beam passage holes in association with the three cathodes K (R, G, B).

In this electron gun assembly, the cathodes and grids are supplied with the following voltages.

The cathodes K (R, G, B) are supplied with a voltage of about 100 to 150V. The first grid G1 is grounded. The second grid G2 is connected to the fourth grid G4 within the tube. The second grid G2 and fourth grid G4 are supplied with a voltage of about 500 to 800V.

The first segment G3-1 of third grid G3 is connected to the first segment G5-1 of fifth grid G5 within the tube. These segments are supplied with a fixed voltage, i.e. focus voltage Vf1, of about 6 kV. The second segment G3-2 of third grid G3 is connected to the second segment G5-2 of fifth grid G5 within the tube. These segments are supplied with a dynamic focus voltage (Vf2+Vd) obtained by superimposing, upon a reference voltage Vf2 of about 6 kV substantially equal to the focus voltage Vf1, an AC component voltage Vd varying parabolically in accordance with an increase in the degree of deflection of electron beams.

The dynamic focus voltage is set such that it is substantially equal to the focus voltage Vf1 in the non-deflection mode in which the electron beams emitted from the cathodes are focused on the central portion of the phosphor screen, and it is higher than the focus voltage Vf1 in the deflection mode in which the electron beams emitted from the cathodes are deflected and focused on a peripheral portion of the phosphor screen.

The sixth grid G6 is supplied with a high voltage of about 26 kV, i.e. an anode voltage Eb.

With the application of the above-described voltages, the electron gun assembly creates the following electron lenses. Specifically, the cathodes K, first grid G1 and second G2 constitutes an electron beam generating section for generating three electron beams and forming an object point relative to a main lens to be described later. The second grid G2 and third grid G3 constitute a prefocus lens for prefocusing the three electron beams generated from the electron beam generating section.

The third grid G3, fourth grid G4 and fifth grid G5 constitute a sub-lens for further prefocusing the three electron beams, which have already been prefocused by the prefocus lens. The fifth grid G5 and sixth grid G6 constitute a main lens for ultimately focusing the three electron beams, which have been prefocused by the sub-lens, on the phosphor screen.

At the time of deflection, a potential difference is provided between the first segment G3-1 and second segment G3-2 of third grid G3, thereby creating a first quadrupole lens. The first quadrupole lens is formed to have a diverging function in the horizontal direction H and a focusing function in the vertical direction V by virtue of the non-circular electron beam passage holes formed in the opposing faces of the first segment G3-1 and second segment G3-2.

At the time of the deflection, a potential difference is provided between the first segment G5-1 and second segment G5-2 of fifth grid G5, thereby creating a second quadrupole lens. The second quadrupole lens is formed to have a focusing function in the horizontal direction H and a diverging function in the vertical direction V by virtue of the non-circular electron beam passage holes formed in the opposing faces of the first segment G5-1 and second segment G5-2.

The lens functions in the electron gun assembly will now be described.

To begin with, the lens functions of the electron gun assembly in the non-deflection mode will be described. The fixed focus voltage Vf1, which is applied to the first segment G3-1 of third grid G3 and the first segment G5-1 of fifth grid G5 is substantially equal to the dynamic focus voltage (Vf2+Vd) applied to the second segment G3-2 of third grid G3 and the second segment G5-2 of fifth grid G5. Thus, neither the first quadrupole lens nor the second quadrupole lens is created.

Figure 9A:
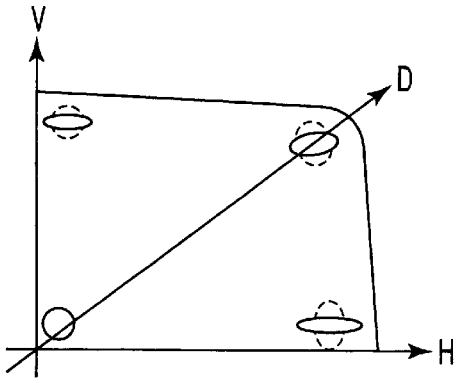
FIG. 9A PRIOR ART
FIG. 9A illustrates a blur of a beam spot on a phosphor screen in the case of a conventional electron gun assembly.
Figure 9B:
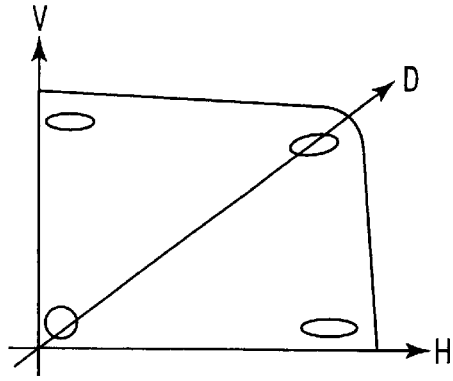
FIG. 9B PRIOR ART
FIG. 9B illustrates oval deformation of a beam spot on the phosphor screen in the case of the conventional electron gun assembly.
Figure 9C:
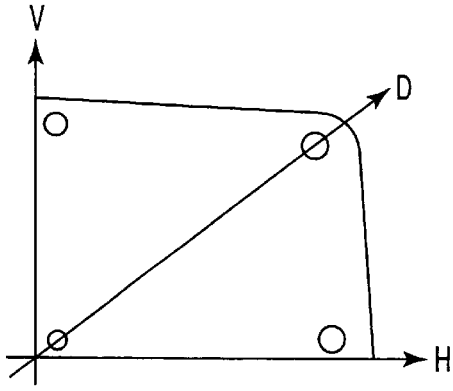
FIG. 9C illustrates a beam spot shape on the phosphor screen of the CRT apparatus according to the embodiment.
Figure 10:
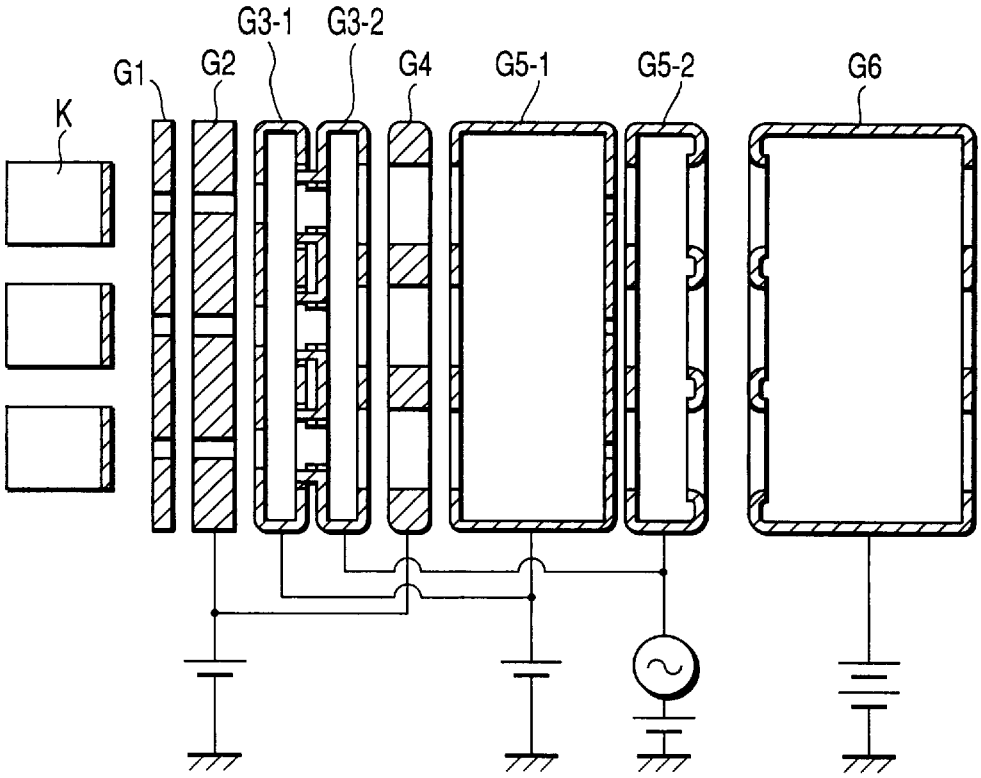
FIG. 10 PRIOR ART
FIG. 10 is a horizontal cross-sectional view schematically showing the structure of a conventional double-quadrupole lens electron gun assembly.
Figure 11A:
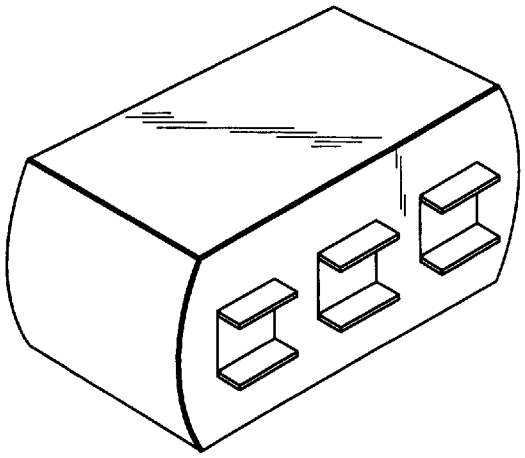
FIG. 11A PRIOR ART
FIGS. 11A and 11B are perspective views schematically showing the structures of grids of a first quadrupole lens of the electron gun assembly shown in FIG. 10.
Figure 11B:
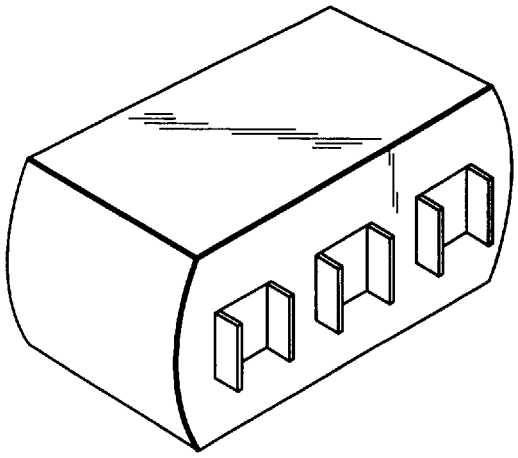
FIG. 11B PRIOR ART
Figure 12A:
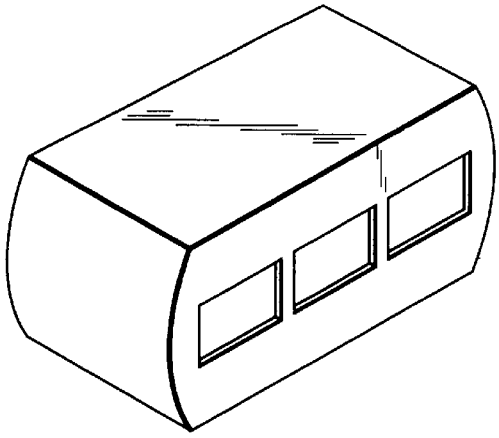
FIG. 12A PRIOR ART
FIGS. 12A and 12B are perspective views schematically showing the structures of grids for creating a quadrupole lens in the conventional electron gun assembly.
Figure 12B:
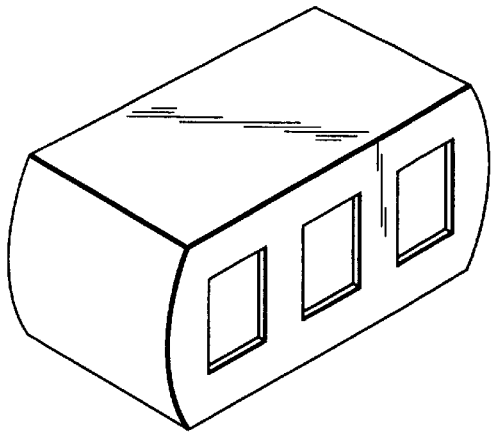
FIG. 12B PRIOR ART
Figure 13A:
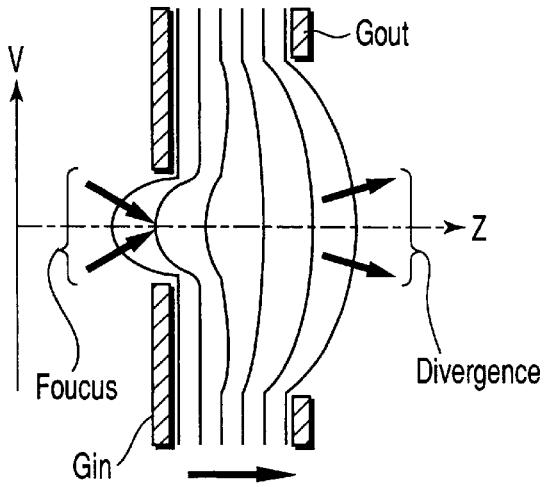
FIG. 13A PRIOR ART
FIGS. 13A and 13B illustrate vertical and horizontal lens actions of the quadrupole lens created by the grids shown in FIGS. 12A and 12B.
Figure 13B:
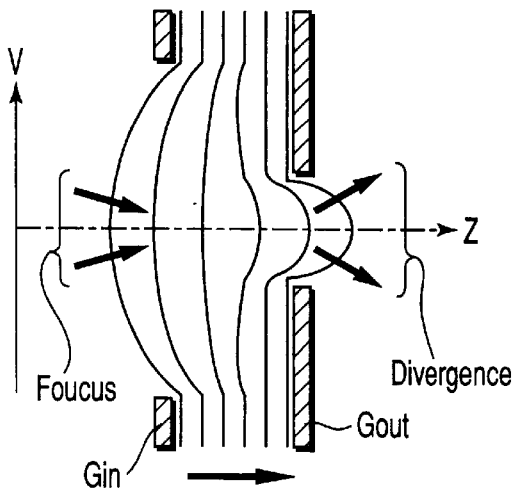
FIG. 13B PRIOR ART

Thus, electron beams emitted from the electron beam generating section are prefocused by the prefocus lens and further prefocused by the sub-lens. The electron beams coming out of the sub-lens are ultimately focused on the phosphor screen 103 by the main lens 24. In this case, the incidence angle in the horizontal direction H of the electron beams landing on the phosphor screen 103 is made substantially equal to that in the vertical direction V. As a result, a circular beam spot can be obtained at the central portion of the phosphor screen, as shown in FIG. 9C.

The lens functions of the electron gun assembly in the deflection mode will be described. When the electron beams are deflected onto the peripheral portion of the phosphor screen, the dynamic focus voltage (Vf2+Vd) applied to the second segment G3-2 of third grid G3 and the second segment G5-2 of fifth grid G5 becomes higher than the fixed focus voltage Vf1 applied to the first segment G3-1 of third grid G3 and the first segment G5-1 of fifth grid G5. In accordance with an increase in degree of deflection of electron beams, the dynamic focus voltage (Vf2+Vd) varies to have a greater potential difference from the fixed focus voltage Vf1.

Thereby, the first quadrupole lens is created between the first segment G3-1 and second segment G3-2 of third grid G3. At the same time, the second quadrupole lens is created between the first segment G5-1 and second segment G5-2 of fifth grid G5.

The first quadrupole lens is created by the horizontally elongated electron beam passage holes G3-11 that are formed in that face of the first segment G3-1, which is opposed to the second segment G3-2, and have major axes in the horizontal direction H and the waist portions G3-12, and the vertically elongated electron beam passage holes G3-21 that are formed in that face of the second segment G3-2, which is opposed to the first segment G3-1, and have major axes in the vertical direction V and the waist portions G3-22. Thereby, the first quadrupole lens has a relatively strong vertical focusing function and a relatively strong horizontal diverging function.

Figure 3A:
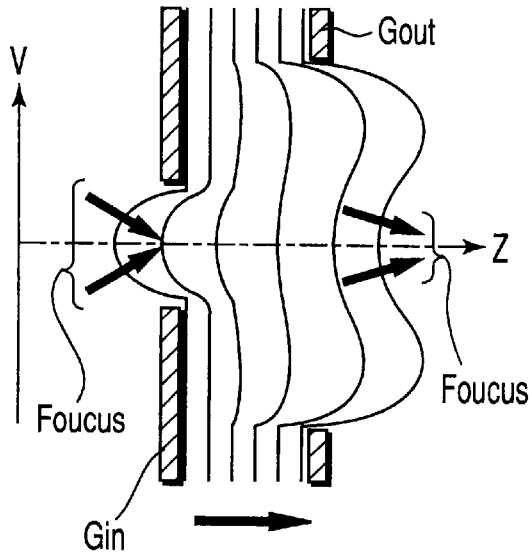
FIGS. 3A and 3B illustrate, respectively, vertical and horizontal lens actions of a first quadrupole lens in the electron gun assembly shown in FIG. 1, and showing equipotential surfaces of the first quadrupole lens.
Figure 3B:
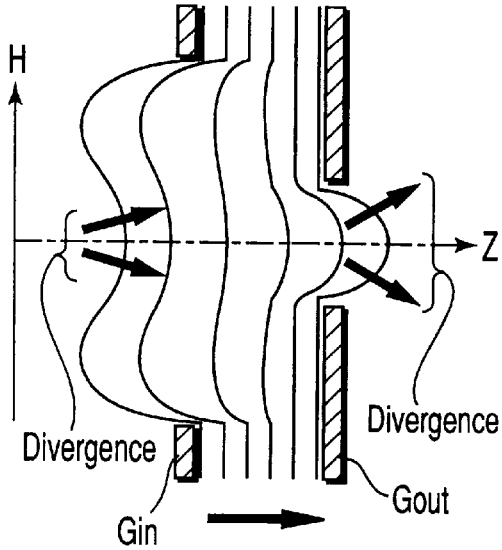

Referring to FIGS. 3A and 3B, a description will now be given of the case where an electron beam enters from the left side in the Figures and exits to the right side. Assume that a voltage V1 is applied to an incidence-side grid (e.g. first segment G3-1) Gin, a voltage V2 is applied to an emission-side grid (e.g. second segment G3-2) Gout, and V1<V2.

As regards the vertical direction V, as shown in FIG. 3A, the electron beam entering the first quadrupole lens suffers a strong focusing action since the vertical dimension of the electron beam passage hole in the incidence-side grid Gin is small. The electron beam exiting the quadrupole lens suffers a strong focusing action. The reason for this is as follows. The electron beam passage hole in the emission-side grid Gout has a large vertical dimension, but it is provided with the waist portion for restricting the horizontal dimension of the region for passing the electron beam, i.e. the lens region acting on the electron beam. Thereby, permeation of electric field between both grids into the emission-side grid Gout is decreased, and in particular permeation of electric field near the center axis Z of the lens is decreased. Thus, the equipotential surface is recessed near the center axis Z of the quadrupole lens. The electron beam suffers a force perpendicular to the equipotential surface. Accordingly, the electron beam, which passes near the lens center axis Z of the emission-side grid Gout, suffers a strong focusing action. As a result, the first quadrupole lens provides a relatively strong focusing action upon the electron beam on the incidence side and emission side in the vertical direction.

On the other hand, as regards the horizontal direction H, as shown in FIG. 3B, the electron beam entering the first quadrupole lens suffers a strong diverging action. The reason for this is as follows. The electron beam passage hole in the incidence-side grid Gin has a large horizontal dimension, but it is provided with the waist portion for restricting the vertical dimension of the region for passing the electron beam. Thereby, permeation of electric field between both grids into the incidence-side grid Gin is decreased, and in particular permeation of electric field near the lens center axis Z is decreased. Thus, the equipotential surface is recessed near the center axis Z of the quadrupole lens. The electron beam suffers a force perpendicular to the equipotential surface. Accordingly, the electron beam, which passes near the lens center axis Z of the incidence-side grid Gin, suffers a strong diverging action. Moreover, the electron beam exiting the quadrupole lens suffers a strong diverging action since the horizontal dimension of the electron beam passage hole in the emission-side grid Gout is small. As a result, the first quadrupole lens provides a relatively strong diverging action upon the electron beam on the incidence side and emission side in the horizontal direction.

In the deflection mode, electron beams emitted from the electron beam generating section are prefocused by the prefocus lens and then suffer a strong vertical focusing action and a strong horizontal diverging action of the first quadrupole lens. Subsequently, the electron beams are prefocused by the sub-lens and then suffers a horizontal focusing action and a vertical diverging action of the second quadrupole lens. The electron beams are ultimately focused on the phosphor screen 103 by the main lens. At this time, a potential difference between the second segment G5-2 of fifth grid G5 and the sixth grid G6, which constitute the main lens, decreases in accordance with an increase in degree of deflection of the electron beams. Thus, the lens power of the main lens weakens, compared to the non-deflection mode.

The above lens functions can compensate the deflection aberration component included in the non-uniform deflection magnetic fields, the variation in divergence angle of the electron beam cased by the first quadrupole lens, and the increase in distance over which the electron beam travels up to the phosphor screen. As a result, if the first quadrupole lens, sub-lens, second quadrupole lens, main lens and deflection aberration components are assumed to be a single lens, a difference between the horizontal lens magnification and the vertical lens magnification can be decreased.

Therefore, as shown in FIG. 9C, the oval deformation of the beam spot on the peripheral portion of the phosphor screen can be improved and the beam spot can be made substantially circular.

As has been described above, according to the color CRT apparatus of this embodiment, the lens power of the main lens can be varied in accordance with the deflection amount of the electron beam. At the same time, the dynamically variable quadrupole lenses are created. Thereby, the blur of the electron beam in the vertical direction due to the deflection aberration can be eliminated. Moreover, this color CRT apparatus adopts the double-quadrupole lens system, and the lens power of the front-stage first quadrupole lens is increased. Thereby, oval deformation of the beam spot is improved, and a substantially circular beam spot can be obtained.

Moreover, according to this color CRT apparatus, the waist portions of the non-circular electron beam holes provided in the grids constituting the first quadrupole lens can be formed by a punching process using a pressing machine. Thus, the dimensional precision can be easily enhanced, and stable focusing performance obtained. Furthermore, since these grids have no projections extending in the direction of travel of electron beams, there are little limitations to the grid interval, and the degree of freedom is increased in designing the electron gun assembly, e.g. the lens magnification, the focus voltage, etc.

The color CRT apparatus of the present invention is not limited to the above-described embodiment.

Figure 5:
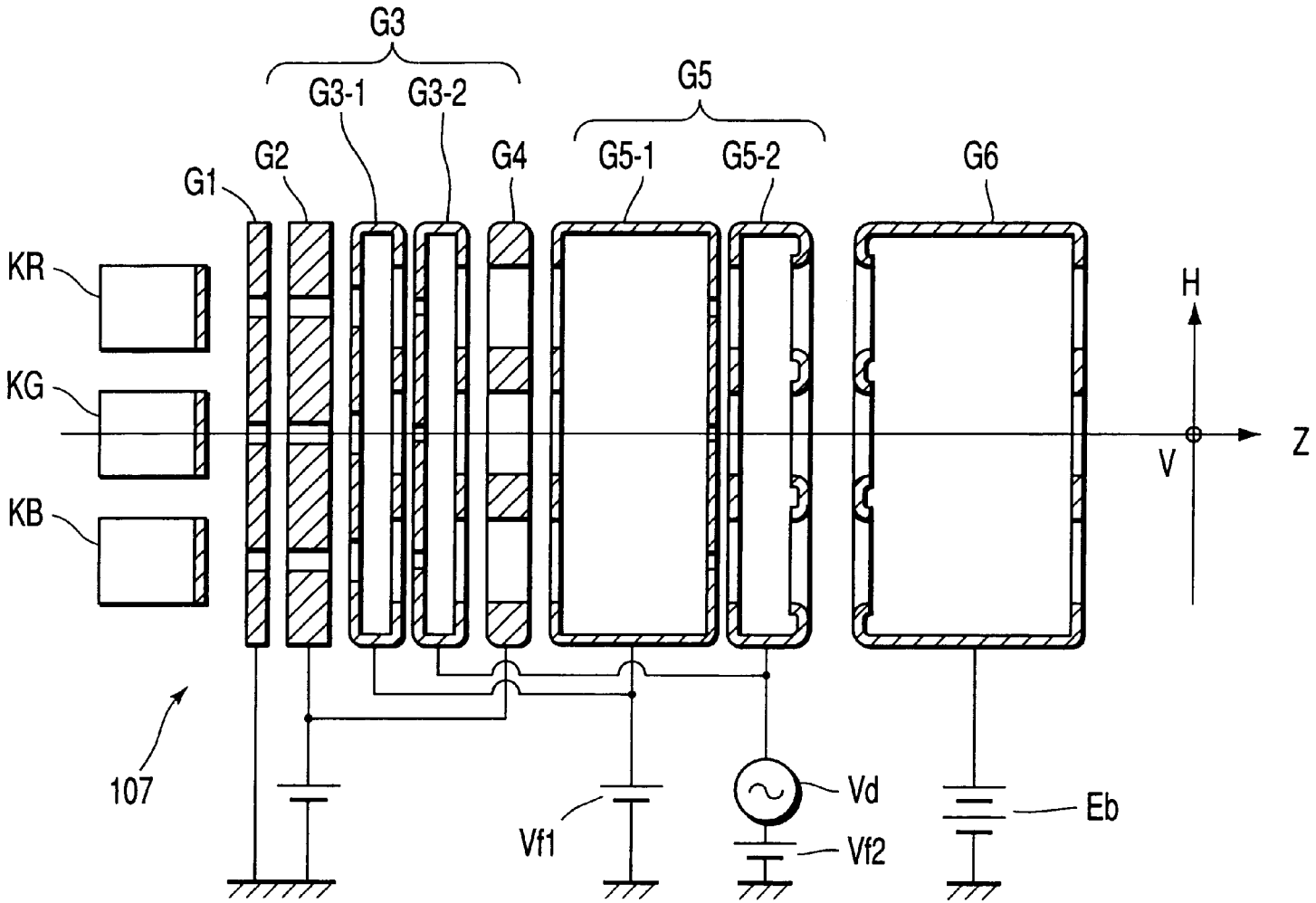
FIG. 5 is a horizontal cross-sectional view schematically showing the structure of an in-line electron gun assembly according to another embodiment of the invention.

For example, an electron gun assembly shown in FIG. 5 has the following structure. The basic structure of this electron gun assembly is the same as that of the preceding embodiment. A first quadrupole lens having a relative strong vertical focusing action and a relatively strong horizontal diverging action is created between the first segment G3-1 and second segment G3-2 of third grid G3. Moreover, a second quadrupole lens having a strong lens power is created.

Figure 6A:
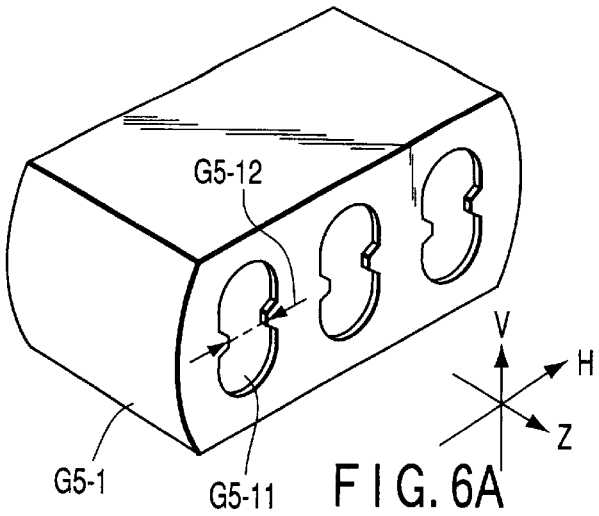
FIG. 6A is a perspective view schematically showing the structure of a first segment of a fifth grid in the electron gun assembly shown in FIG. 5.

Specifically, as is shown in FIG. 6A, that face of the first segment G5-1 of fifth grid G5, which is opposed to the second segment G5-2, has non-circular electron beam passage holes G5-11 having major axes in the vertical direction V. Each electron beam passage hole G5-11 has a waist portion G5-12 at which the horizontal dimension of the region for substantially passing the electron beam takes a minimum value. Specifically, the waist portion G5-12 is formed to project toward the substantial center of the cross section of the electron beam passing through the electron beam passage hole G5-11.

Figure 6B:
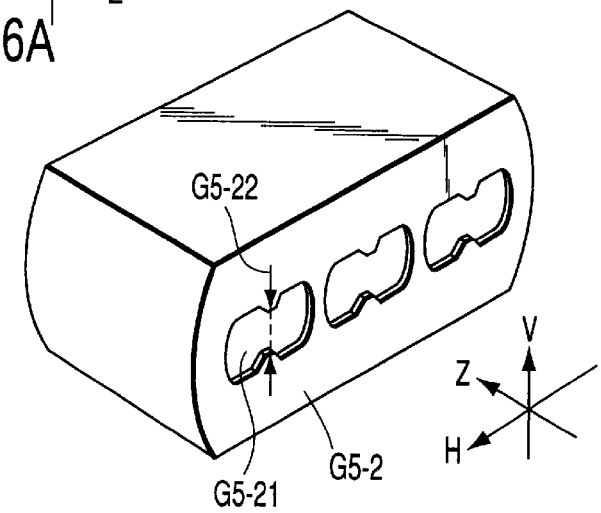
FIG. 6B is a perspective view schematically showing the structure of a second segment of the fifth grid in the electron gun assembly shown in FIG. 5.

As is shown in FIG. 6B, that face of the second segment G5-2 of fifth grid G5, which is opposed to the first segment G5-1, has non-circular electron beam passage holes G5-21 having major axes in the horizontal direction H. Each electron beam passage hole G5-21 has a waist portion G5-22 at which the vertical dimension of the region for substantially passing the electron beam takes a minimum value. Specifically, the waist portion G5-21 is formed to project toward the substantial center of the cross section of the electron beam passing through the electron beam passage hole G5-21.

The lens functions of the electron gun assembly in the deflection mode will be described. When the electron beams are deflected onto the peripheral portion of the phosphor screen, the dynamic focus voltage (Vf2+Vd) applied to the second segment G5-2 of fifth grid G5 becomes higher than the focus voltage Vf1 applied to the first segment G5-1 of fifth grid G5. In accordance with an increase in degree of deflection of electron beams, the dynamic focus voltage (Vf2+Vd) varies to have a greater potential difference from the focus voltage Vf1.

Thereby, the second quadrupole lens is created between the first segment G5-1 and second segment G5-2 of fifth grid G5.

The second quadrupole lens is created by the vertically elongated electron beam passage holes G5-11 that are formed in that face of the first segment G5-1, which is opposed to the second segment G5-2, and have major axes in the vertical direction V and the waist portions G5-12, and the horizontally elongated electron beam passage holes G5-21 that are formed in that face of the second segment G5-2, which is opposed to the first segment G5-1, and have major axes in the horizontal direction H and the waist portions G5-22. Thereby, the second quadrupole lens has a relatively strong vertical diverging function and a relatively strong horizontal focusing function.

Figure 7A:
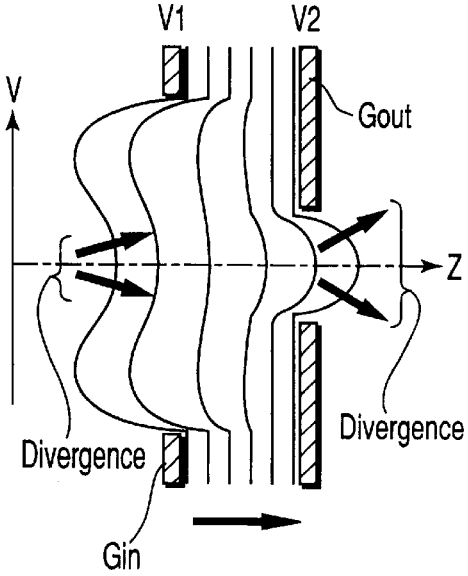
FIGS. 7A and 7B illustrate, respectively, vertical and horizontal lens actions of a second quadrupole lens in the electron gun assembly shown in FIG. 5, and showing equipotential surfaces of the second quadrupole lens.
Figure 7B:
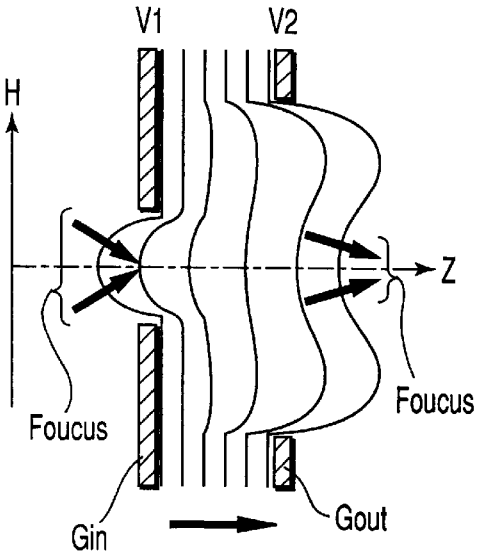
Figure 8:
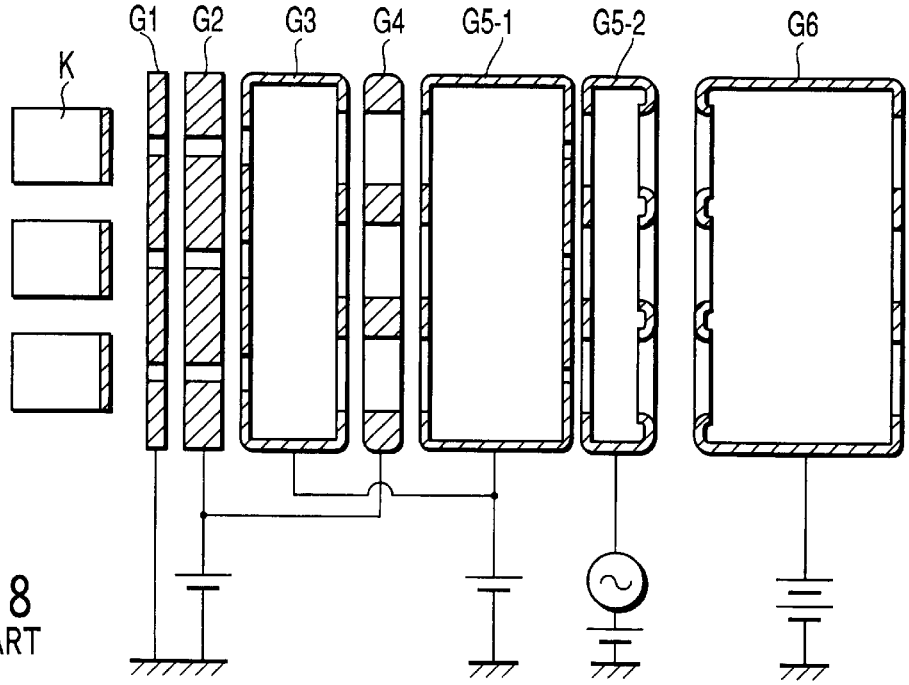
FIG. 8 PRIOR ART
FIG. 8 is a horizontal cross-sectional view schematically showing the structure of a conventional QPF double-focus electron gun assembly.

Referring to FIGS. 7A and 7B, a description will now be given of the case where an electron beam enters from the left side in the Figures and exits to the right side. Assume that a voltage V1 is applied to an incidence-side grid (e.g. first segment G5-1) Gin, a voltage V2 is applied to an emission-side grid (e.g. second segment G5-2) Gout, and V1<V2.

As regards the vertical direction V, as shown in FIG. 7A, the electron beam entering the second quadrupole lens suffers a strong diverging action. The reason for this is as follows. The electron beam passage hole in the incidence-side grid Gin has a large vertical dimension, but it is provided with the waist portion for restricting the horizontal dimension of the region for passing the electron beam. Thereby, permeation of electric field between both grids into the incidence-side grid Gin is decreased, and in particular permeation of electric field near the lens center axis Z is decreased. Thus, the equipotential surface is recessed near the center axis Z of the quadrupole lens. Accordingly, the electron beam, which passes near the lens center axis Z of the incidence-side grid Gin, suffers a strong diverging action. Moreover, the electron beam exiting the quadrupole lens suffers a strong diverging action since the vertical dimension of the electron beam passage hole in the emission-side grid Gout is small. As a result, the second quadrupole lens provides a relatively strong diverging action upon the electron beam on the incidence side and emission side in the vertical direction.

On the other hand, as regards the horizontal direction H, as shown in FIG. 7B, the electron beam entering the second quadrupole lens suffers a strong focusing action since the horizontal dimension of the electron beam passage hole in the incidence-side grid Gin is small. The electron beam exiting the quadrupole lens suffers a strong focusing action. The reason for this is as follows. The electron beam passage hole in the emission-side grid Gout has a large horizontal dimension, but it is provided with the waist portion for restricting the vertical dimension of the region for passing the electron beam. Thereby, permeation of electric field between both grids into the emission-side grid Gout is decreased, and in particular permeation of electric field near the center axis Z of the lens is decreased. Thus, the equipotential surface is recessed near the center axis Z of the quadrupole lens. Accordingly, the electron beam, which passes near the lens center axis Z of the emission-side grid Gout, suffers a strong focusing action. As a result, the second quadrupole lens provides a relatively strong focusing action upon the electron beam on the incidence side and emission side in the horizontal direction.

In the deflection mode, electron beams emitted from the electron beam generating section are prefocused by the prefocus lens and then suffer a strong vertical focusing action and a strong horizontal diverging action of the first quadrupole lens. Subsequently, the electron beams are prefocused by the sub-lens and then suffers a strong horizontal focusing action and a strong vertical diverging action of the second quadrupole lens. The electron beams are ultimately focused on the phosphor screen 103 by the main lens. At this time, a potential difference between the second segment G5-2 of fifth grid G5 and the sixth grid G6, which constitute the main lens, decreases in accordance with an increase in degree of deflection of the electron beams. Thus, the lens power of the main lens weakens, compared to the non-deflection mode.

The above lens functions can compensate the deflection aberration component included in the non-uniform deflection magnetic fields, the variation in divergence angle of the electron beam cased by the first quadrupole lens, and the increase in distance over which the electron beam travels up to the phosphor screen. As a result, if the first quadrupole lens, sub-lens, second quadrupole lens, main lens and deflection aberration components are assumed to be a single lens, a difference between the horizontal lens magnification and the vertical lens magnification can further be decreased.

Therefore, as shown in FIG. 9C, the oval deformation of the beam spot on the peripheral portion of the phosphor screen can be improved and the beam spot can be made substantially circular.

With the color CRT apparatus having the above structure, too, the same advantages as with the preceding embodiment can be obtained.

As has been described above, according to the color CRT apparatuses of the embodiments, oval deformation of the beam spot can be decreased over the entire phosphor screen with simple structures, and a substantially circular beam spot can be obtained. Therefore, good focus characteristics can stably be obtained over the entire phosphor screen.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode-ray tube apparatus comprising:

an electron gun assembly including, an electron beam generating section which generates electron beams, a main lens which focuses the electron beams generated by the electron beam generating section on a phosphor screen, a first quadrupole lens situated between the electron beam generating section and the main lens, and having a horizontal diverging function and a vertical focusing function, and a second quadrupole lens situated between the electron beam generating section and the main lens, and having a horizontal focusing function and a vertical diverging function; and a deflection yoke which generates deflection magnetic fields that horizontally and vertically deflect the electron beams emitted from the electron gun assembly, wherein the electron gun assembly includes at least one multi-polar lens that is created in accordance with deflection of the electron beams, said at least one multi-polar lens is created by two mutually opposing grids, said two mutually opposing grids including non-circular electron beam passage holes in their mutually facing surfaces, and each of the electron beam passage holes including a waist portion which minimizes a horizontal or vertical dimension of a region for passing the associated electron beam.

2. A cathode-ray tube apparatus comprising:

an electron gun assembly including, an electron beam generating section which generates electron beams, and a main lens which focuses the electron beams generated by the electron beam generating section on a phosphor screen; and a deflection yoke which generates deflection magnetic fields that horizontally and vertically deflect the electron beams emitted from the electron gun assembly, wherein the electron gun assembly includes at least one multi-polar lens that is created in accordance with deflection of the electron beams, said at least one multi-polar lens is created by two mutually opposing grids, said two mutually opposing grids including non-circular electron beam passage holes in their mutually facing surfaces, and wherein each of the electron beam passage holes in one of the grids that create the multi-polar lens has a waist portion that minimizes a horizontal dimension of a region for passing the associated electron beam, and each of the electron beam passage holes in the other of the grids that create the multi-polar lens has a waist portion that minimizes a vertical dimension of the region for passing the associated electron beam.

3. A cathode-ray tube apparatus comprising:

an electron gun assembly including, an electron beam generating section which generates electron beams, and a main lens which focuses the electron beams generated by the electron beam generating section on a phosphor screen; and a deflection yoke which generates deflection magnetic fields that horizontally and vertically deflect the electron beams emitted from the electron gun assembly, wherein the electron gun assembly includes at least one multi-polar lens that is created in accordance with deflection of the electron beams, said at least one multi-polar lens is created by two mutually opposing grids, said two mutually opposing grids including non-circular electron beam passage holes in their mutually facing surfaces, each of the electron beam passage holes including a waist portion which minimizes a horizontal or vertical dimension of a region for passing the associated electron beam, and wherein said multi-polar lens comprises a quadrupole lens having a horizontal focusing function and a vertical diverging function, and these lens functions vary in accordance with deflection of the electron beams.

4. A cathode-ray tube apparatus according to claim 3, wherein each of the electron beam passage holes in that one of the grids creating the quadrupole lens, which is disposed on the electron beam generating section side, has a waist portion that minimizes said horizontal dimension, and each of the electron beam passage holes in the other grid disposed on the main lens side has a waist portion that minimizes said vertical dimension.

5. A cathode-ray tube apparatus according to claim 4, wherein said other grid disposed on the main lens side is supplied with a voltage higher than a voltage applied to said one grid disposed on the electron beam generating section side, when the electron beams are deflected.

6. A cathode-ray tube apparatus comprising:

an electron gun assembly including, an electron beam generating section which generates electron beams, and a main lens which focuses the electron beams generated by the electron beam generating section on a phosphor screen; and a deflection yoke which generates deflection magnetic fields that horizontally and vertically deflect the electron beams emitted from the electron gun assembly, wherein the electron gun assembly includes at least one multi-polar lens that is created in accordance with deflection of the electron beams, said at least one multi-polar lens is created by two mutually opposing grids, said two mutually opposing grids including non-circular electron beam passage holes in their mutually facing surfaces, each of the electron beam passage holes including a waist portion which minimizes a horizontal or vertical dimension of a region for passing the associated electron beam, and wherein said multi-polar lens comprises a quadrupole lens having a horizontal diverging function and a vertical focusing function, and these lens functions vary in accordance with deflection of the electron beams.

7. A cathode-ray tube apparatus according to claim 6, wherein each of the electron beam passage holes in that one of the grids creating the quadrupole lens, which is disposed on the electron beam generating section side, has a waist portion that minimizes said vertical dimension, and each of the electron beam passage holes in the other grid disposed on the main lens side has a waist portion that minimizes said horizontal dimension.

8. A cathode-ray tube apparatus according to claim 7, wherein said other grid disposed on the main lens side is supplied with a voltage higher than a voltage applied to said one grid disposed on the electron beam generating section side, when the electron beams are deflected.

* * * * *